US009210768B2

(12) United States Patent
Adler et al.

(10) Patent No.: US 9,210,768 B2
(45) Date of Patent: Dec. 8, 2015

(54) ILLUMINATION TECHNIQUES AND DEVICES

(71) Applicant: OSRAM SYLVANIA Inc., Danvers, MA (US)

(72) Inventors: Helmar Adler, Danvers, MA (US); Seung Cheol Ryu, Middlebury, CT (US); Michael Quilici, Essex, MA (US); Peter Wendling, Beverly, MA (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 13/768,361

(22) Filed: Feb. 15, 2013

(65) Prior Publication Data

US 2014/0232292 A1 Aug. 21, 2014

(51) Int. Cl.
*H05B 37/02* (2006.01)
*H05B 33/08* (2006.01)

(52) U.S. Cl.
CPC ..... *H05B 37/02* (2013.01); *H05B 33/0857* (2013.01)

(58) Field of Classification Search
CPC ..... H05B 37/02; H05B 33/0815; H05B 33/0842; H05B 33/0845
USPC ..... 315/294
See application file for complete search history.

(56) References Cited

U.S. PATENT DOCUMENTS 6,166,946 A * 12/2000 Naffziger ..... 365/154
7,515,128 B2 * 4/2009 Dowling ..... 345/83
7,598,686 B2 * 10/2009 Lys et al. ..... 315/312
8,207,946 B2 * 6/2012 Abileah et al. ..... 345/173
8,218,920 B2 * 7/2012 Van Ostrand et al. ..... 385/31
8,278,840 B2 * 10/2012 Logiudice et al. ..... 315/294
8,493,003 B2 * 7/2013 Zhao ..... 315/308
8,648,548 B2 * 2/2014 Sakai ..... 315/307
8,779,681 B2 * 7/2014 Adler ..... 315/291
8,820,963 B2 * 9/2014 Olsen et al. ..... 362/244
2005/0030744 A1 * 2/2005 Ducharme et al. ..... 362/231
2005/0040774 A1 * 2/2005 Mueller et al. ..... 315/291

(Continued)

FOREIGN PATENT DOCUMENTS

WO WO2008/147753 A2 12/2008

OTHER PUBLICATIONS

European Search Report to App. # 14154792.7-1802, Dated Jun. 26, 2014.

*Primary Examiner* — Tung X Le
*Assistant Examiner* — Srinivas Sathiraju
(74) *Attorney, Agent, or Firm* — Andrew Martin

(57) ABSTRACT

Illumination techniques and related devices are disclosed. In some cases, a lighting device configured as described herein may include a front luminaire configured to emit white light and a back luminaire configured to emit colored light. The lighting device can be operatively coupled with controller circuitry programmed or otherwise configured, for example, with one or more algorithms which control the light output of the front and/or back luminaire so as to provide tunability. In some cases, device output may be controlled so as to: (1) simulate lighting conditions/patterns corresponding to the daytime/nighttime on Earth; (2) support/alter physiological processes; and/or (3) provide a specific ambient lighting for a given space. In some instances, a system of multiple such lighting devices can be provided, and in some cases, communication between constituent lighting devices may be provided. In some instances, the lighting device may be mountable as a sconce or other lighting fixture.

23 Claims, 6 Drawing Sheets

(56) References Cited

U.S. PATENT DOCUMENTS

| | | | | |
|---|---|---|---|---|
| 2005/0116667 | A1* | 6/2005 | Mueller et al. | 315/312 |
| 2007/0115665 | A1* | 5/2007 | Mueller et al. | 362/276 |
| 2007/0285921 | A1 | 12/2007 | Zulim et al. | |
| 2008/0094005 | A1* | 4/2008 | Rabiner et al. | 315/294 |
| 2009/0128044 | A1 | 5/2009 | Nevins | |
| 2010/0188018 | A1* | 7/2010 | Salm | 315/294 |
| 2010/0264432 | A1* | 10/2010 | Liu et al. | 257/89 |
| 2011/0199019 | A1* | 8/2011 | McClear et al. | 315/294 |
| 2012/0206050 | A1 | 8/2012 | Spero | |
| 2012/0306380 | A1* | 12/2012 | Adler | 315/152 |
| 2012/0306381 | A1* | 12/2012 | Adler | 315/152 |
| 2012/0320626 | A1* | 12/2012 | Quilici et al. | 362/606 |
| 2013/0002144 | A1* | 1/2013 | Adler | 315/153 |
| 2014/0055041 | A1* | 2/2014 | Ramer et al. | 315/153 |
| 2014/0062297 | A1 | 3/2014 | Bora et al. | |
| 2014/0063779 | A1* | 3/2014 | Bradford | 362/84 |
| 2014/0320024 | A1* | 10/2014 | Adler | 315/153 |

* cited by examiner

Figure 6
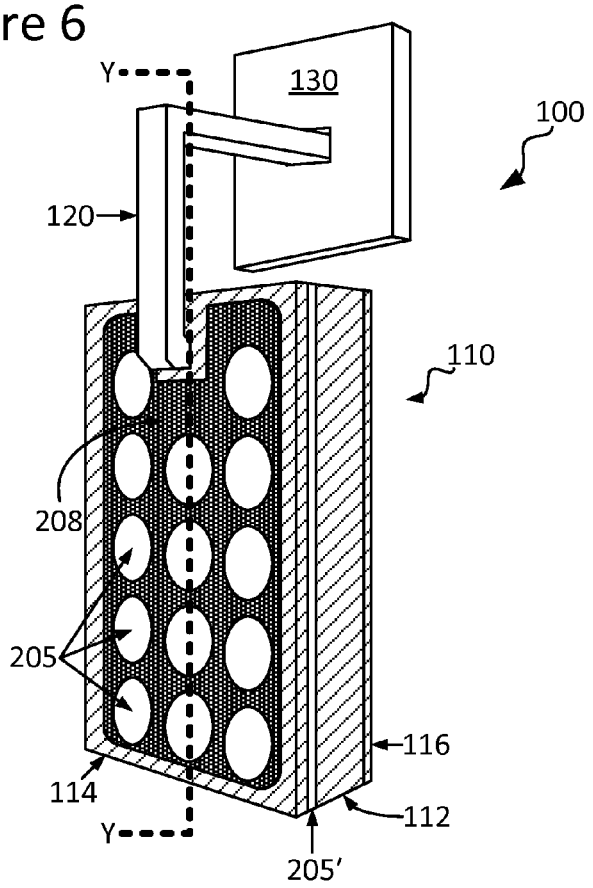
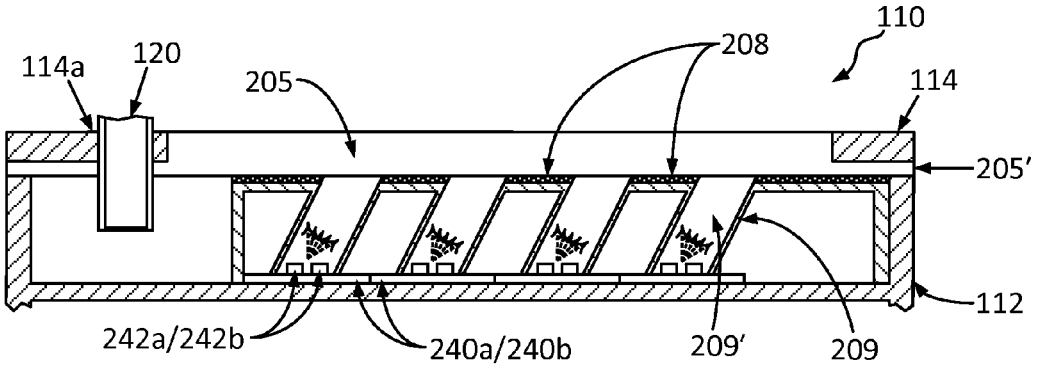
Figure 7

ILLUMINATION TECHNIQUES AND DEVICES

FIELD OF THE DISCLOSURE

The disclosure relates to lighting and more particularly to lighting design and techniques.

BACKGROUND

Lighting design involves a number of non-trivial challenges, and lighting devices have faced particular complications, such as those with respect to achieving realistic daylight replication.

BRIEF DESCRIPTION OF THE DRAWINGS

FIG. 6 is a side perspective view of a light fixture configured in accordance with another embodiment of the present invention.

FIG. 7 is a partial side cross-sectional view of the lighting device of the light fixture of FIG. 6 taken along the dashed line Y-Y therein.

Figure 1:
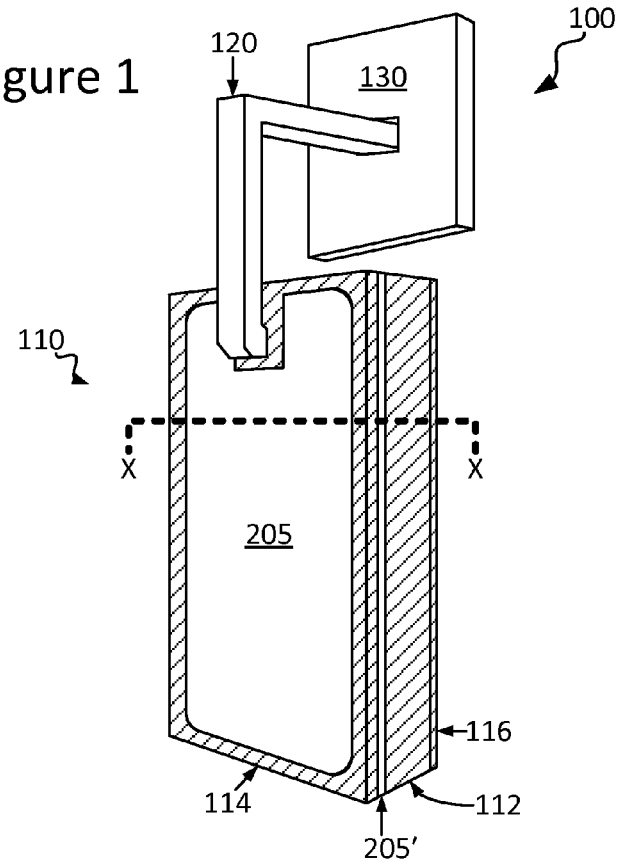
FIG. 1 is a side perspective view of a light fixture configured in accordance with an embodiment of the present invention.

These and other features of the present embodiments will be understood better by reading the following detailed description, taken together with the figures herein described. The accompanying drawings are not intended to be drawn to scale. In the drawings, each identical or nearly identical component that is illustrated in various figures may be represented by a like numeral. For purposes of clarity, not every component may be labeled in every drawing.

DETAILED DESCRIPTION

Illumination techniques and related devices are disclosed. In some cases, a lighting device configured as described herein may include a front luminaire configured to emit white light and a back luminaire configured to emit colored light. The lighting device can be operatively coupled with controller circuitry programmed or otherwise configured, for example, with one or more algorithms which control the light output of the front and/or back luminaire so as to provide tunability. In some cases, device output may be controlled so as to: (1) simulate lighting conditions/patterns corresponding to the daytime/nighttime on Earth; (2) support/alter physiological processes (e.g., sleep, mood, etc.); and/or (3) provide a specific ambient lighting for a given space. In some instances, a system of multiple such lighting devices can be provided, and in some cases, communication between constituent lighting devices may be provided. In some instances, the lighting device may be mountable to a wall or other suitable surface in a sconce-like fashion. In some instances, the lighting device may be mountable to or in a ceiling, for example, as a hanging fixture, drop ceiling fixture, etc. Numerous configurations and variations will be apparent in light of this disclosure.

General Overview

As previously indicated, there are a number of non-trivial issues that can complicate realistic daylight replication/simulation with a given light source. For instance, one non-trivial issue pertains to the fact that daylight on Earth is, by its very nature, a very dynamic phenomenon. The color and intensity of light provided by the sun change dramatically over the course of a day. Furthermore, the properties of daylight experienced at a given location on Earth or any other planet, celestial body, etc., typically depend heavily on the latitude and longitude of that location. Still further, the daylight experienced at a given location is subject to changes, for example, due to the time of day, the season, the weather, outside structures, vegetation, environmental conditions, etc. In short, such factors/considerations do not seem to be considered with respect to existing light sources and techniques.

Thus, and in accordance with an embodiment of the present invention, techniques and related devices are disclosed for replicating or otherwise simulating lighting conditions/patterns corresponding to the daytime/nighttime on Earth, or some other specific lighting theme of interest. In some embodiments, a lighting device configured as described herein may include, for example: (1) a front luminaire configured to emit white light; and/or (2) a back luminaire configured to emit colored light. In some instances, such a lighting device can be operatively coupled with embedded and/or external controller circuitry programmed, for example, with one or more algorithms which control the light output of the front and/or back luminaire so as to provide tunability.

In some cases, and in accordance with an embodiment, the light output of a lighting device configured as described herein may be controlled, for example, so as to simulate lighting conditions/patterns corresponding to the daytime/nighttime on Earth (e.g., at any given geographical location, at any given time of day/season, etc.). However, the claimed invention is not so limited, as in some other cases, and in accordance with another embodiment, the light output of a given lighting device provided as described herein can be controlled, for instance, so as to support/alter physiological processes (e.g., circadian rhythms/sleep, mood, etc.). In some cases, and in accordance with another embodiment, the light output of a given lighting device provided as described herein can be controlled, for instance, to provide a desired ambient lighting for a given space/setting. More generally, and in accordance with an embodiment, the output of the luminaire(s) of a lighting device configured as described herein can be controlled/tuned to provide such lighting device with any of a wide range of lighting profiles to support specific lighting themes or moods.

In some embodiments, a lighting device configured as described herein can be mounted or otherwise attached (e.g., permanently, removably, etc.) to any of a wide range of surfaces/structures (e.g., a wall, a ceiling, a floor, a step, or any other suitable structure/infrastructure). In some embodiments, a lighting device provided as described herein may be configured to be electrically coupled, for example, with an electrical junction box (e.g., local to the mounting surface). However, as discussed below, the claimed invention is not so limited, as in some embodiments, a lighting device configured as described herein can be configured to be electrically coupled, for example, with a battery or other portable power source, which may allow for portable/mobile operation of the lighting device. In some cases, a plurality of lighting devices configured as described herein may be implemented as a modular lighting system configured, for example, to achieve any of the various lighting profiles described herein.

As will be appreciated in light of this disclosure, some embodiments of the present invention may have any of a wide range of configurations. For example, some embodiments may be implemented, in part or in whole, as: (1) a light fixture (e.g., a wall sconce, an overhead light, a nightlight, etc.); (2) a task light; (3) an accent light; (4) an emergency light; (5) a flashlight; and/or (6) any other suitable configuration, as will be apparent in light of this disclosure. Furthermore, and in accordance with an embodiment, a lighting device provided using the disclosed techniques can be configured, for example, as: (1) a partially/completely assembled lighting unit; and/or (2) a kit or other collection of discrete components (e.g., a lighting device, mounting componentry, etc.) which may be operatively coupled as desired.

As will be further appreciated in light of this disclosure, some embodiments of the present invention can be utilized in any of a wide variety of applications/end-uses in any of a wide variety of contexts/settings. For instance, some embodiments may be implemented, in part or in whole: (1) in a home/consumer setting (e.g., lighting to aid in falling asleep and/or waking up; mood lighting for a given room/space; etc.); (2) in a commercial setting (e.g., in retail stores/shops, sports stadiums/arenas, exercise studios, etc.); (3) in a workplace setting (e.g., in offices/production floors to increase productivity; in conference rooms to encourage peaceful/calm interactions; etc.); (4) in the hospitality industry (e.g., in hotel hallways/rooms to aid in acclimating travelers arriving from different time zones); (5) in windowless spaces where it may be desirable to provide a real sense/feeling of time (e.g., in a museum, subway station, etc.); and/or (6) as travel/transit lighting (e.g., on trains, buses, etc.). In some other example cases, some embodiments may be implemented in settings such as hospitals, homes, assisted living facilities, etc., to assist the elderly or persons with medical conditions (e.g., Alzheimer's disease, etc.) to regain a sense of time. In some further example cases, some embodiments may be implemented in settings in which it may be difficult or impossible to observe or otherwise perceive daylight patterns typically experienced, for instance, on Earth's surface (e.g., deep sea exploration/colonization, space exploration/colonization, etc.) Other suitable applications/end-uses will be apparent in light of this disclosure.

Structure and Operation

FIG. 1 is a side perspective view of a light fixture 100 configured in accordance with an embodiment of the present invention. As can be seen, light fixture 100 may include, in some embodiments: a lighting device 110; a mounting arm 120 coupled with lighting device 110; and/or a mounting interface 130 coupled with mounting arm 120. As will be appreciated in light of this disclosure, light fixture 100 may include additional, fewer, and/or different elements or components from those here described, and the claimed invention is not intended to be limited to any particular system configurations, but can be used with numerous configurations in numerous applications.

Figure 2:
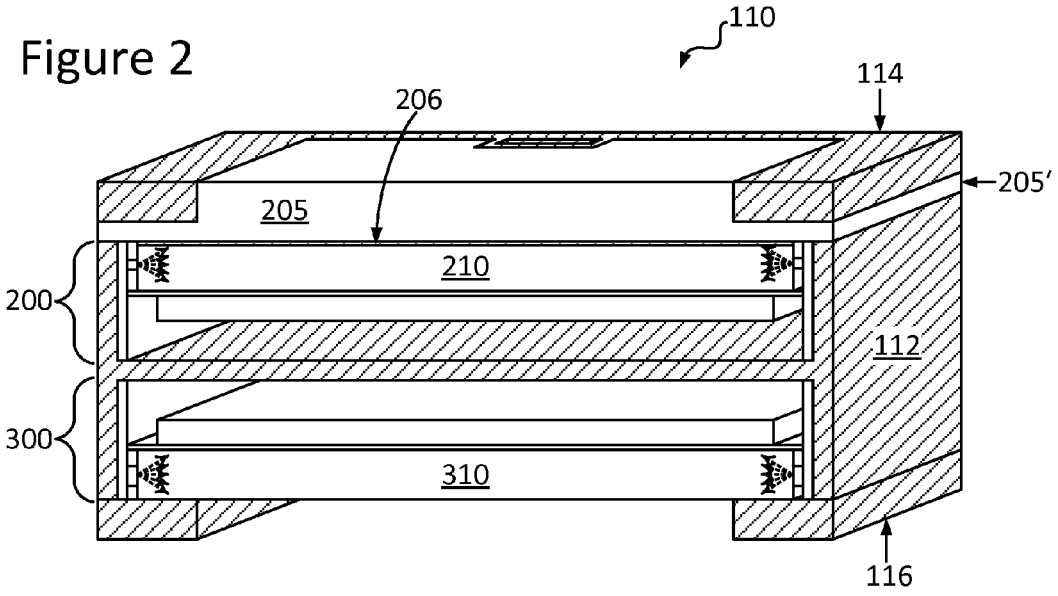
FIG. 2 is a side cross-sectional view of the lighting device of the light fixture of FIG. 1 taken along the dashed line X-X therein.

FIG. 2 is a side cross-sectional view of the lighting device 110 of the light fixture 100 of FIG. 1 taken along the dashed line X-X therein. As can be seen, lighting device 110 may include, in some embodiments: a front luminaire 200; a back luminaire 300; a housing 112 configured to house front luminaire 200 and/or back luminaire 300 (and, in some cases, any componentry/structure associated therewith); a front faceplate 114; and/or a back faceplate 116. In some cases, lighting device 110 also may include an optical window 205 and/or a diffuser 206 (both discussed below) optically coupled, for example, with lightguide 210. As will be appreciated in light of this disclosure, lighting device 110 may include additional, fewer, and/or different elements or components from those here described, and the claimed invention is not intended to be limited to any particular device configurations, but can be used with numerous configurations in numerous applications.

In some embodiments, lighting device 110 may be configured for double-sided emission (e.g., emission from both a front luminaire 200 and a back luminaire 300 thereof). However, the claimed invention is not so limited, as in some other instances, lighting device 110 may be configured for single-sided emission (e.g., emission for either a front luminaire 200 or a back luminaire 300). Also, in some embodiments, lighting device 110 may be configured to emit, at least in part, from one or more of its edges/sides (e.g., from a sandwiched edge/portion 205' of optical window 205, discussed below). Numerous configurations will be apparent in light of this disclosure.

Figure 3:
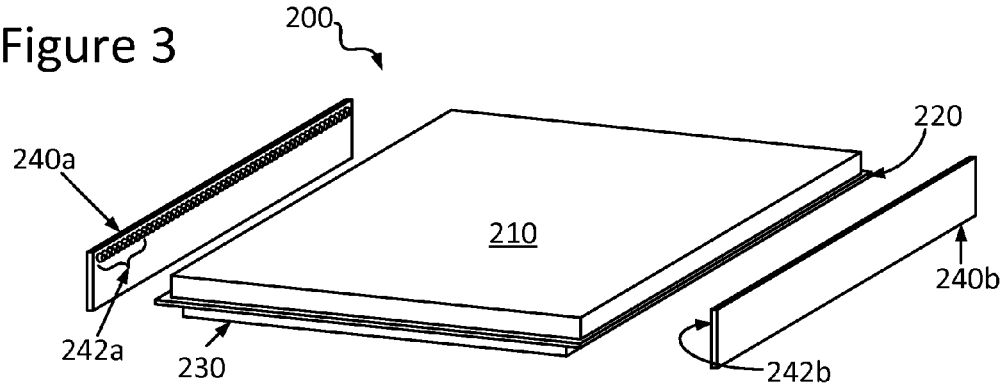
FIG. 3 is a partially exploded view of a front luminaire configured in accordance with an embodiment of the present invention.

FIG. 3 is a partially exploded view of a front luminaire 200 configured in accordance with an embodiment of the present invention. As can be seen, front luminaire 200 may include, in some embodiments: a lightguide 210; a reflector 220 disposed behind lightguide 210 (e.g., proximate a back/non-emitting surface thereof); and an optional support plate 230 disposed behind reflector 220. In some cases, front luminaire 200 may be configured, for example, as an edge-lit luminaire. To that end, and in accordance with an embodiment, one or more light engines 242*a*/242*b* (which, in some instances, may be populated on one or more printed circuit boards 240*a*/240*b*) may be optically coupled with lightguide 210 at one or more input sides/edges thereof. However, the claimed invention is not so limited, as in some other instances, front luminaire 200 may be configured for direct optical coupling (e.g., one or more light engines 242*a*/242*b* may be optically coupled with lightguide 210 at one or more input front/back surfaces thereof). In some instances, a combination of edge-coupling and direct coupling may be implemented for a given front luminaire 200. As will be further appreciated in light of this disclosure, front luminaire 200 may include additional, fewer, and/or different elements or components from those here described (e.g., films, polarizers, other optical components, etc.), and the claimed invention is not intended to be limited to any particular configuration, but can be used with numerous configurations in numerous applications.

In accordance with an embodiment, lightguide 210 may comprise a bulk/quantity of optical material having the ability: (1) to have light optically coupled therein (e.g., as provided by one or more light engines 242*a*/242*b*, discussed below); and/or (2) to transmit/emit the wavelength(s) of interest (e.g., visible, ultraviolet, infrared, etc.) of the light coupled therein. In accordance with an embodiment, lightguide 210 may be configured to extract light coupled therein by means of any of a wide variety of light extraction mechanisms/processes, such as, but not necessarily limited to: (1) total internal reflection (TIR); (2) reflection; (3) refraction; (4) transmission; (5) absorption; (6) scattering; and/or (7) any other light extraction techniques/mechanisms suitable for extracting light from within a lightguide, as will be apparent in light of this disclosure. Other suitable configurations for lightguide 210 will depend on a given application and will be apparent in light of this disclosure.

In accordance with an embodiment, lightguide 210 may be constructed from any of a wide range of materials. Some example suitable materials may include, but are not necessarily limited to: (1) a transparent plastic or other polymer, such as poly(methyl methacrylate) (PMMA), polycarbonate, etc.; (2) a transparent ceramic, glass, or other crystal, such as sapphire ($Al_2O_3$), yttrium aluminum garnet (YAG), etc.; (3) a combination of any of the aforementioned; and/or (4) any other optical material suitable for a lightguide, as will be apparent in light of this disclosure. In some cases, lightguide 210 also optionally may have one or more optical and/or protective coatings (e.g., anti-reflective, diffractive, diffusive, etc.) disposed thereon. Other suitable materials and/or coatings for a given lightguide 210 will depend on a given application and will be apparent in light of this disclosure.

Also, and in accordance with an embodiment, lightguide 210 may be configured with any given geometry/shape, as desired for a given application or end-use. For instance, lightguide 210 may be configured as any three-dimensional structure, such as, but not necessarily limited to: (1) a square/rectangular plate (e.g., such as is illustrated in FIG. 3); (2) a circular/elliptical plate; (3) a ring-like shape; and/or (4) any other desired custom three-dimensional structure, as will be apparent in light of this disclosure. Furthermore, and in accordance with an embodiment, lightguide 210 can be configured as a substantially planar structure or as a curved, rounded, or otherwise non-planar structure. Still further, and in accordance with an embodiment, the dimensions (e.g., length, width/diameter, height/thickness, etc.) of lightguide 210 can be customized as desired. Other suitable geometries/shapes and/or dimensions for lightguide 210 will depend on a given application and will be apparent in light of this disclosure.

In some embodiments, front luminaire 200 may include a reflector 220, for example, disposed behind a given non-emitting surface (e.g., a back surface) of lightguide 210, as desired for a given target application or end-use. In accordance with an embodiment, reflector 220 may aid in reflecting/redirecting at least a portion (e.g., substantially all) of the light extracted from lightguide 210 back towards/through the desired output/emitting surface (e.g., front surface) of lightguide 210. Therefore, in some such instances, substantially all of the light extracted from lightguide 210, regardless of initial direction of extraction, may be made to pass through a single output/front surface of lightguide 210 of front luminaire 200 and out of the front side of lighting device 110. It may be desirable to ensure that a given reflector 220 is implemented sufficiently proximate to the desired surface of lightguide 210 (e.g., such that any gap there between is in the range of a few micrometers to a few millimeters) to ensure a sufficient amount of reflection. In some cases, reflector 220 may be configured as a film, sheet, or other layer of reflective material which provides a desired degree of reflection. Other suitable configurations for reflector 220 will depend on a given application and will be apparent in light of this disclosure.

In accordance with an embodiment, reflector 220 may comprise any of a wide range of materials. For instance, in some cases, it may be desirable to provide a reflector 220 which is generally diffusive reflective; to that end, and in accordance with one or more embodiments, reflector 220 may comprise a material such as polyethylene terephthalate (PET), microcellular PET (MCPET), etc. In some other cases, it may be desirable to provide a reflector 220 which is specular reflective; to that end, and in accordance with one or more embodiments, reflector 220 may comprise a material such as aluminum (Al), gold (Au), silver (Ag), etc. In some cases, the material used for a given reflector 220 may be chosen, at least in part, based on its ability to reflect the wavelength(s) of interest of the light (e.g., visible, ultraviolet, infrared, etc.) provided by the one or more light engines 242*a*/242*b* (discussed below). Other suitable materials for reflector 220 will depend on a given application and will be apparent in light of this disclosure.

In some embodiments, front luminaire 200 optionally may include a support plate 230, for example, to help provide lightguide 210 and/or reflector 220 with structural support within housing 212, to aid in alignment of lightguide 210 with the one or more light engines 242*a*/242*b*, and/or to provide a desired degree of conductive cooling for the one or more light engines 242*a*/242*b* of luminaire 200. Thus, as will be appreciated in light of this disclosure, and in accordance with an embodiment, support plate 230 may be constructed from any of a wide range of materials, such as, but not necessarily limited to, aluminum (Al), stainless steel, copper (Cu), a plastic material, a composite material, and/or a combination of any of the aforementioned. Other suitable configurations and/or materials for optional support plate 230 will depend on a given application and will be apparent in light of this disclosure.

Figure 5:
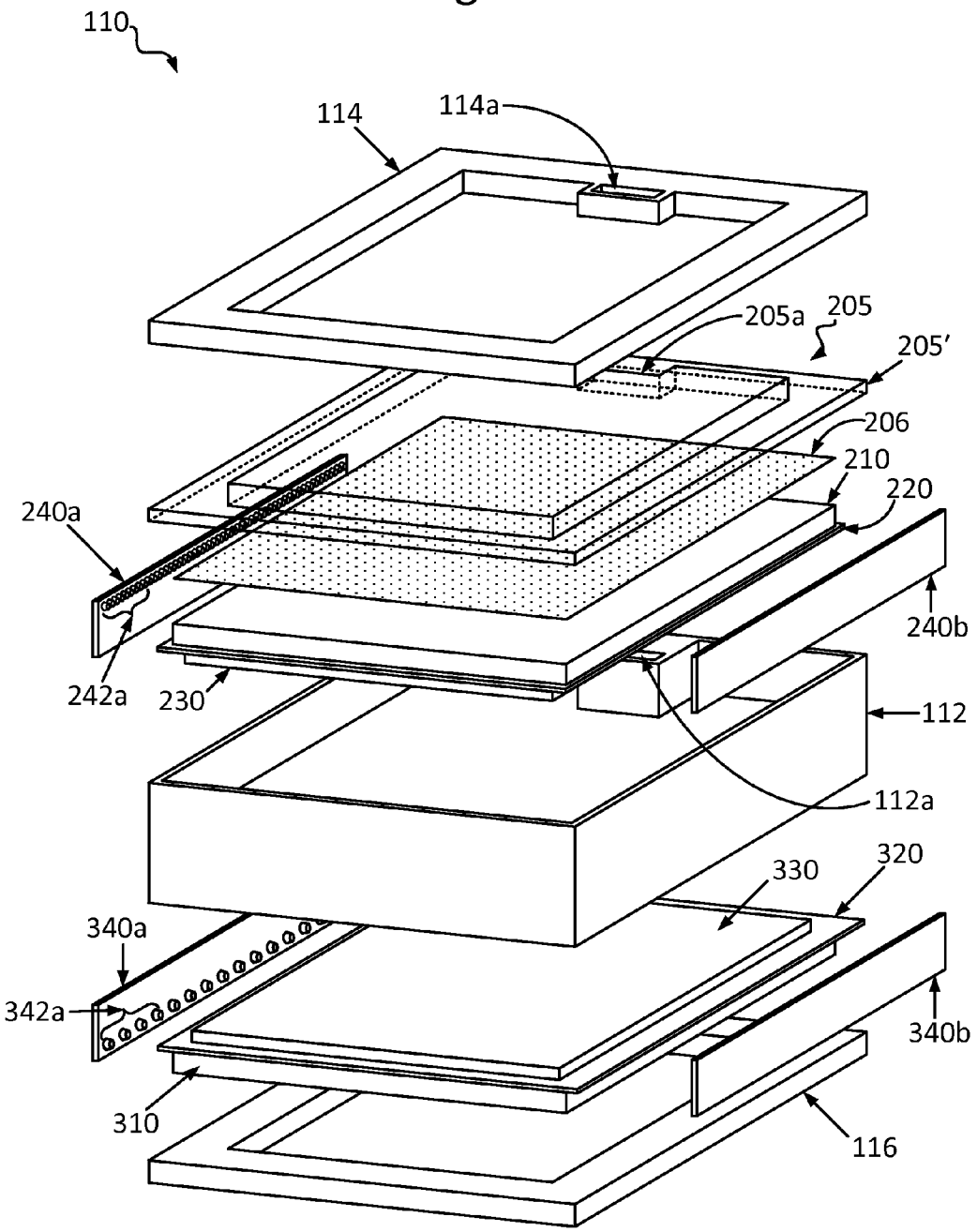
FIG. 5 is an exploded view of a lighting device configured in accordance with an embodiment of the present invention.

As previously noted, and as can be seen from FIGS. 2 and 5, an optical window 205 optionally may be implemented with front luminaire 200, in some cases. In accordance with one or more embodiments, optical window 205 may comprise any of a wide range of optical materials, such as, but not necessarily limited to: (1) acrylic; (2) polycarbonate; and/or (3) any other suitably transparent, translucent, etc., optical material, as will be apparent in light of this disclosure. In some cases, optical window 205 may be provided with a single thickness; however, the claimed invention is not so limited, as in some other cases, optical window 205 may be provided with a varying thickness (e.g., tiered, stepped, recessed, fluctuating, undulating, etc.). For instance, in some embodiments, an optical window 205 may have a stepped cross-sectional profile (e.g., such as the optical window 205 depicted in FIGS. 2 and 5). In some such cases, the stepped cross-sectional profile may aid in providing a clean fit, for example, between optical window 205 and front faceplate 114, which in turn may aid in enhancing the aesthetics/appearance of lighting device 110. Also, in some instances, a stepped cross-sectional profile may allow for a portion 205' of optical window 205 to be sandwiched, for example, between front faceplate 114 and housing 112.

As can further be seen from FIGS. 2 and 5, and as previously noted, a diffuser 206 optionally may be implemented with front luminaire 200, in some embodiments. In some cases, diffuser 206 may be configured, for example, as a sheet which may be included between the emitting side of lightguide 210 and the back side of optical window 205. It should be noted, however, that the claimed invention is not so limited. For instance, in some other cases, diffuser 206 may be configured as a film that is deposited or otherwise formed, for example, on the back side of optical window 205 proximate to the emitting side of lightguide 210. In either scenario, diffuser 206 may aid in diffusing light emitted by front luminaire 200, in accordance with an embodiment. Also, in some cases, it may be desirable to increase the forward candela distribution of front luminaire 200. To that end, in some embodiments, a brightness-enhancing film (BEF) may be included, for example, between optical window 205 and diffuser 206. Other suitable configurations for optical window 205, diffuser 206, and/or any associated films/coatings will depend on a given application and will be apparent in light of this disclosure.

As can be seen from FIG. 5, optical window 205 may include, in some instances, a recess/aperture 205*a* formed therein, for example, for receiving mounting arm 120. As will be appreciated in light of this disclosure, it may be desirable in some such instances to ensure that recess/aperture 205*a* substantially aligns with a recess/aperture 112*a* of housing 112 and/or a recess/aperture 114*a* of front faceplate 114, both discussed below. Other suitable configurations, dimensions, and/or materials for a given optional optical window 205 and/or optional diffuser 206 will depend on a given application and will be apparent in light of this disclosure.

FIG. 6 is a side perspective view of a light fixture 100 configured in accordance with another embodiment of the present invention, and FIG. 7 is a partial side cross-sectional view of the lighting device 110 of the light fixture 100 of FIG. 6 taken along the dashed line Y-Y therein. As can be seen from these figures, in some cases, lighting device 110 optionally may include a mask 208 and/or a mask structure 209, for example, behind optical window 205. In some cases, mask 208 and mask structure 209 may be separate or otherwise discrete components; however, the claimed invention is not so limited, as in some other cases, mask 208 and mask structure 209 may be integrally formed. As can be seen, mask structure 209 may include one or more features 209' configured to direct out of optical window 205 (or otherwise out of lighting device 110) the light emitted by light engines 242*a*/242*b*. In some example cases, a plurality of features 209' having a generally tubular geometry may be provided and configured to direct the light emitted by light engines 242*a*/242*b* therethrough. In some instances, a given tubular feature 209' may be angled so as to generally direct outbound light downwardly or otherwise away from an observer's eyes. Also, in some instances, a diffuser (e.g., sheet, film, etc.) may be included between mask 208 and optical window 205, for example, to aid in reducing glare. Furthermore, and in accordance with one or more embodiments, mask 208 and/or mask structure 209 may be formed, in part or in whole, using a three-dimensional printing process or any other suitable formation process/technique, as will be apparent in light of this disclosure.

In some embodiments, mask features 209' may provide front luminaire 200 with one or more non-emitting regions, reduce the intensity of light emitted by front luminaire 200, and/or reduce glare from front luminaire 200 by redirecting the light emitted therefrom (e.g., in a downward or other desired direction). In accordance with an embodiment, the arrangement of mask features 209' of a given mask structure 209 may be, for example, patterned, randomized, stylized, etc. In short, mask 208 and/or mask structure 209 may be provided with any desired geometry and/or any desired dimensions, as desired for a given target application or end-use. As will be appreciated in light of this disclosure, it may be desirable in some instances in which a mask 208/mask structure 209 is implemented to configure front luminaire 200 for direct light emission (e.g., light engines 242*a*/242*b* may be permitted to emit light directly out of optical window 205 without the presence of a lightguide 210). Other suitable uses and/or configurations for a given mask 208/mask structure 209 will depend on a given application and will be apparent in light of this disclosure.

Returning to FIGS. 2, 3, and 5, as can be seen one or more light engines 242*a*/242*b* may be optically coupled with lightguide 210 and configured to emit/couple light therein, in accordance with an embodiment. As will be appreciated in light of this disclosure, and in accordance with an embodiment, light provided by the one or more light engines 242*a*/242*b* can be coupled into lightguide 210 by way of any of a wide variety of light coupling means/mechanisms. For example, in some cases, front luminaire 200 may be configured for edge-coupling; that is, one or more light engines 242*a*/242*b* (e.g., LEDs) may be optically coupled with an input side/edge of lightguide 210. In some other cases, front luminaire 200 may be configured for direct coupling; that is, one or more light engines 242*a*/242*b* (e.g., LEDs) may be optically coupled with an input front/back surface of lightguide 210. As previously noted, in some cases, front luminaire 200 may be configured for both edge-coupling and direct coupling. Numerous configurations will be apparent in light of this disclosure.

In accordance with an embodiment, a given light engine 242*a*/242*b* may be configured to emit light of any desired spectral emission band (e.g., visible spectral band, infrared spectral band, ultraviolet spectral band, etc.) suitable for a given target application or end-use. In some embodiments, a given light engine 242*a*/242*b* may comprise a semiconductor light source, such as a light emitting diode (LED). Some example suitable semiconductor light sources for a given light engine 242*a*/242*b* may include, but are not necessarily limited to: (1) high-brightness semiconductor LEDs; (2) organic light emitting diodes (OLEDs); (3) single color LEDs; (4) multiple-color (e.g., bi-color, tri-color, etc.) LEDs; (5) polymer light emitting diodes (PLEDs); (6) electroluminescent (EL) strips; and/or (7) a combination of any of the aforementioned. Other suitable types of light engines 242*a*/242*b* and/or spectral ranges for front luminaire 200 will depend on a given application and will be apparent in light of this disclosure.

As discussed below, in some embodiments, front luminaire 200 may be configured with light engines 242*a*/242*b* capable, for example, of dual-white emission (e.g., cool white and warm white). As further discussed below, front luminaire 200 may be operatively coupled with controller circuitry which may provide for dual-white tuning/mixing within lightguide 210. In some instances, the light which may be emitted from front luminaire 200 may be tuned to have a color temperature, for example, in the range of about 2700-6500 K. Thus, as will be appreciated in light of this disclosure, front luminaire 200 may be capable of emitting a wide range of white light (e.g., warm white, cool white, daylight, etc.). In some example instances, front luminaire 200 may be configured to provide task lighting, accent lighting, safety lighting, and/or lighting which may resemble a celestial light source (e.g., the sun, the moon, a star, etc.). Other suitable tuning capabilities, color temperature ranges, and/or lighting usages will depend on a given application and will be apparent in light of this disclosure.

Figure 4:
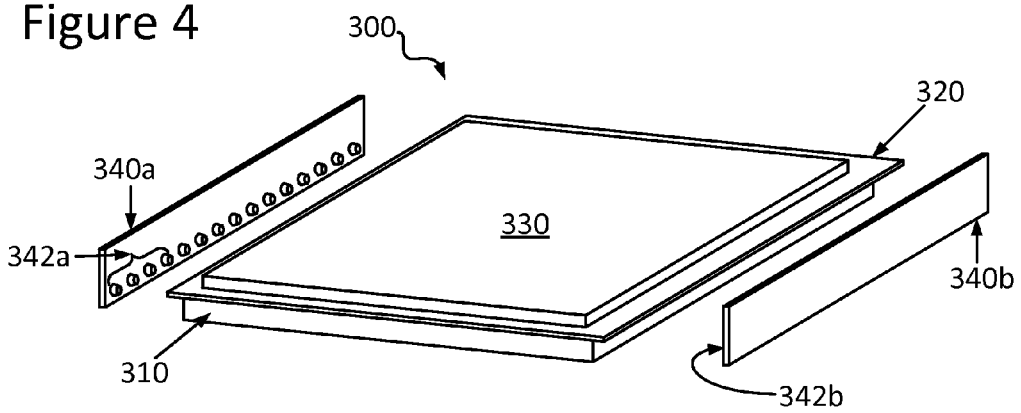
FIG. 4 is a partially exploded view of a back luminaire configured in accordance with an embodiment of the present invention.

FIG. 4 is a partially exploded view of a back luminaire 300 configured in accordance with an embodiment of the present invention. As will be appreciated in light of this disclosure, and in accordance with an embodiment, back luminaire 300 may be configured in much the same way as front luminaire 200, discussed above. For example, as can be seen from FIG. 4, back luminaire 300 may include, in some embodiments: a lightguide 310; a reflector 320 disposed behind lightguide 310 (e.g., proximate a back/non-emitting surface thereof); and an optional support plate 330 disposed behind reflector 320. In some cases, back luminaire 300 may be configured, for example, as an edge-lit luminaire. To that end, and in accordance with an embodiment, one or more light engines 342*a*/342*b* (which, in some instances, may be populated on one or more printed circuit boards 340*a*/340*b*) may be optically coupled with lightguide 310 at one or more input sides/edges thereof. However, the claimed invention is not so limited, as in some other instances, back luminaire 300 may be configured for direct optical coupling (e.g., one or more light engines 342*a*/342*b* may be optically coupled with lightguide 310 at one or more input front/back surfaces thereof). In some instances, a combination of edge-coupling and direct coupling may be implemented for a given back luminaire 300. As will be further appreciated in light of this disclosure, back luminaire 300 may include additional, fewer, and/or different elements or components from those here described (e.g., films, polarizers, other optical components, etc.), and the claimed invention is not intended to be limited to any particular configuration, but can be used with numerous configurations in numerous applications.

As will be appreciated in light of this disclosure, the discussion provided above in the context of front luminaire 200 of suitable light extraction mechanisms/processes, materials, optional coatings, geometries, dimensions, configurations, and/or capabilities for lightguide 210 may be applied equally here in the context of lightguide 310 of back luminaire 300, in accordance with one or more embodiments.

As will be further appreciated in light of this disclosure, the discussion provided above in the context of front luminaire 200 of suitable placements, materials, configurations, and/or capabilities for reflector 220 may be applied equally here in the context of reflector 320 of back luminaire 300, in accordance with one or more embodiments.

As will be yet further appreciated in light of this disclosure, the discussion provided above in the context of front luminaire 200 of suitable placements, materials, configurations, and/or capabilities for optional support plate 230 may be applied equally here in the context of optional support plate 330 of back luminaire 300, in accordance with one or more embodiments.

Also, in some embodiments, an optical window and/or diffuser optionally may be implemented with back luminaire 300. As will be appreciated in light of this disclosure, the discussion provided above in the context of front luminaire 200 of suitable placements, materials, thicknesses, configurations, and/or capabilities for optional optical window 205 and/or optional diffuser 206 may be applied equally here with back luminaire 300, in accordance with one or more embodiments. However, in some instances, the mounting surface 1002 (discussed below) with which light fixture 100 can be mounted may be sufficiently diffusive of the light emitted by back luminaire 300, and thus, in some embodiments, back luminaire 300 may be implemented without inclusion of a diffuser. Numerous suitable configurations will be apparent in light of this disclosure.

In accordance with an embodiment, one or more light engines 342*a*/342*b* may be optically coupled with lightguide 310 and configured to emit/couple light therein. As will be appreciated in light of this disclosure, the discussion provided above in the context of front luminaire 200 of suitable light coupling mechanisms/means, spectral emission band(s), light source types, configurations, and/or capabilities for light engines 242*a*/242*b* may be applied equally here in the context of the one or more light engines 342*a*/342*b* of back luminaire 300, in accordance with one or more embodiments.

In some embodiments, back luminaire 300 may be configured with light engines 342*a*/342*b* capable, for example, of multi-colored emission (e.g., red-green-blue, or R-G-B, LEDs; or other color schemes). As further discussed below, back luminaire 300 may be operatively coupled with controller circuitry which may provide for R-G-B (or other desired color) tuning/mixing within lightguide 310. In some instances, the light which may be emitted from back luminaire 300 may be tuned to any desired color and/or intensity. Thus, as will be appreciated in light of this disclosure, back luminaire 300 may be capable of emitting a wide range of highly tunable colored light. Other suitable tuning capabilities and/or lighting usages will depend on a given application and will be apparent in light of this disclosure.

FIG. 5 is an exploded view of a lighting device 110 configured in accordance with an embodiment of the present invention. As can be seen from FIGS. 2 and 5, lighting device 110 may include a housing 112 configured to house, in part or in whole, front luminaire 200 and/or back luminaire 300. In some cases, housing 112 may include a recess/aperture 112*a* formed therein, for example, for receiving mounting arm 120. As will be appreciated in light of this disclosure, it may be desirable in some instances to ensure that recess/aperture 112*a* substantially aligns with recess/aperture 114*a* of front faceplate 114, discussed below. Other suitable configurations for housing 112 will depend on a given application and will be apparent in light of this disclosure.

In some embodiments, housing 112 may be configured to have engaged therewith: (1) a front faceplate 114, for example, at the front side of housing 112 configured to retain front luminaire 200; and/or (2) a back faceplate 116, for example, at the back side of housing 112 configured to retain back luminaire 300. In some instances, front faceplate 114 may be configured, for example, to receive a portion of optical window 205 (e.g., as previously noted, an optical window 205 having a stepped profile may aid in providing a clean fit, for example, between optical window 205 and front faceplate 114, which in turn may aid in enhancing the aesthetics/appearance of lighting device 110). In some such instances, a portion 205' of optical window 205 may be sandwiched between front faceplate 114 and housing 112, as can be seen from FIG. 2, for example. In some cases, front faceplate 114 may include a recess/aperture 114*a* formed therein, for example, for receiving mounting arm 120. As will be appreciated in light of this disclosure, it may be desirable in some instances to ensure that recess/aperture 114*a* substantially aligns with recess/aperture 112*a* of housing 112, discussed above. Other suitable configurations for front faceplate 114 and/or back faceplate 116 will depend on a given application and will be apparent in light of this disclosure.

In accordance with an embodiment, housing 112, front faceplate 114, and/or back faceplate 116 may be constructed from any of a wide variety of materials. Some example suitable materials may include, but are not necessarily limited to, aluminum (Al) (e.g., anodized Al), stainless steel, copper (Cu), brass, a plastic material, a composite material, and/or a combination of any of the aforementioned (e.g., a nickel-plated metal, a chrome-plated metal/plastic, etc.). In some instances, housing 112 (and/or front faceplate 114, back faceplate 116, etc.) may be constructed from a material (e.g., Al, etc.) which may provide front luminaire 200 and/or back luminaire 300 with a desired degree of conductive cooling, for example, for its one or more light engines 242*a*/242*b* and/or 342*a*/342*b*. Other suitable construction materials for housing 112, front faceplate 114, and/or back faceplate 116 will depend on a given application and will be apparent in light of this disclosure.

As will be appreciated in light of this disclosure, it may be desirable in some instances to provide lighting device 110 with a desired amount of cooling (e.g., such as when high-brightness light engines 242*a*/242*b* and/or 342*a*/342*b* are utilized). To that end, in some embodiments, housing 112 optionally may include structure/devices configured to provide a lighting device that is: (1) conductively cooled; (2) air cooled (e.g., one or more fans); (3) liquid cooled; and/or (4) cooled using a combination of any of the aforementioned. Other suitable techniques/devices for optionally cooling lighting device 110 will depend on a given application and will be apparent in light of this disclosure.

Figure 8:
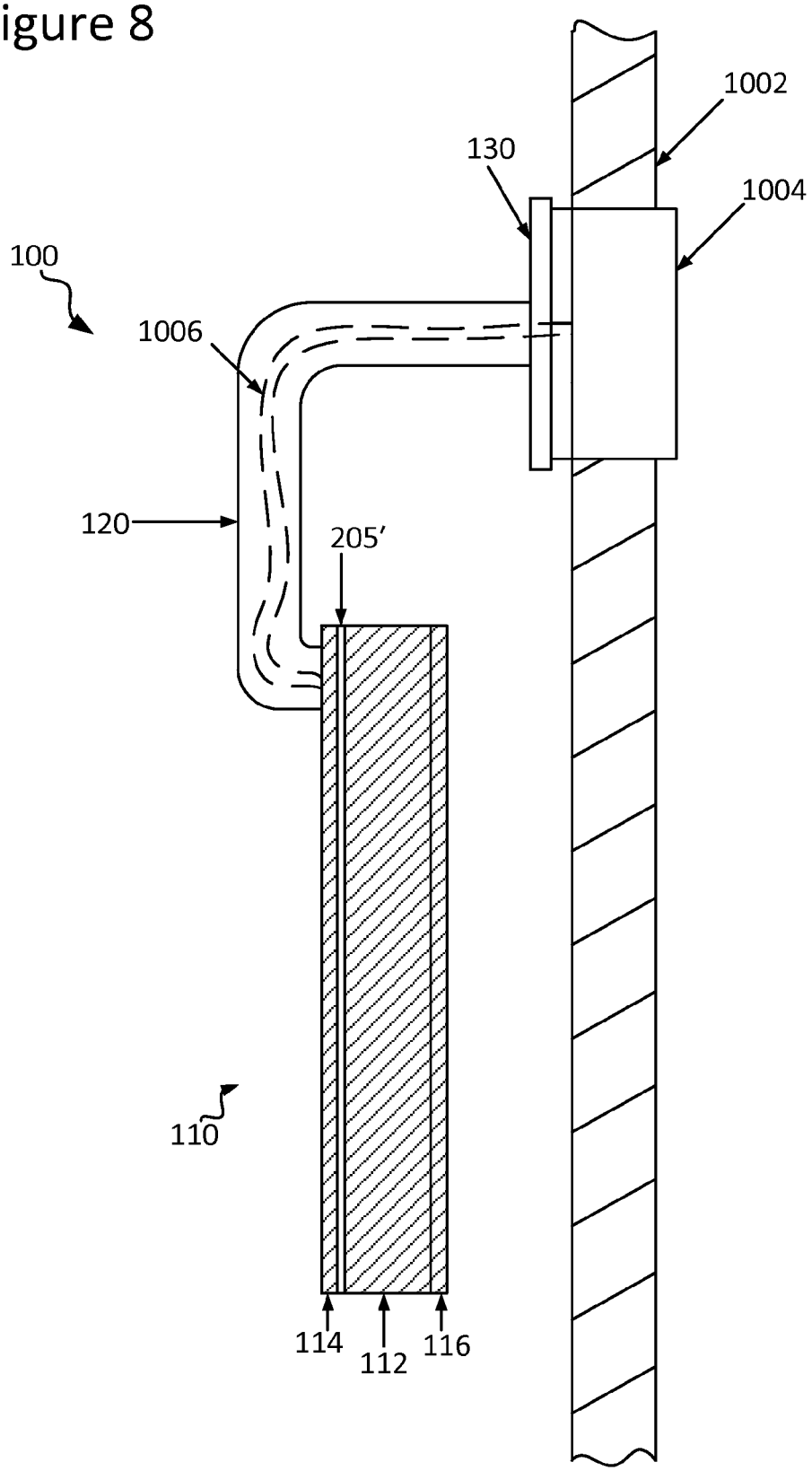
FIG. 8 is a side view of a light fixture mounted to a mounting surface, in accordance with an embodiment of the present invention.

FIG. 8 is a side view of a light fixture 100 mounted to a mounting surface 1002, in accordance with an embodiment of the present invention. As previously noted, mounting surface 1002 can be any of a wide range of surfaces, such as, but not necessarily limited to, a wall, a ceiling, a floor, a step, or any other suitable structure/infrastructure, as will be apparent in light of this disclosure. In some cases, lighting device 110 may be configured to be hardwired or otherwise electrically coupled, for example, with an electrical junction box 1004 (e.g., provided at mounting surface 1002).

However, the claimed invention is not so limited. For instance, in some cases, lighting device 110 (or more generally, light fixture 100) may be configured to be electrically coupled with an external battery. In some cases, lighting device 110 may include an on-board or otherwise integrated battery. In some other instances, light fixture 100 may be configured to be plugged into or otherwise temporarily/removably electrically coupled with an electrical junction box 1004 or other power source (e.g., light fixture 100 may be plugged into a wall socket or other electrical outlet/source). In some cases, light fixture 100 may be configured to be plugged into an intermediate device (e.g., a charging unit, a power converter, etc.) which in turn is configured to be plugged into a wall socket/outlet. Other suitable mounting surfaces 1002 and/or power supplies will depend on a given application and will be apparent in light of this disclosure.

As previously noted, in some cases, light fixture 100 may include a mounting arm 120. In accordance with an embodiment, mounting arm 120 may be configured to provide lighting device 110 with a given degree of structural support, for example, relative to a given mounting surface 1002. As will be appreciated in light of this disclosure, mounting arm 120 may have any of a wide variety of configurations. For example, in some cases, mounting arm 120 may be provided with any given curvature (e.g., rounded, angled, straight, etc.). In some instances, mounting arm 120 may be provided with a degree of flexibility/articulation, which may allow for lighting device 110 to be moved closer to and/or farther away from mounting surface 1002, as desired. In some cases, mounting arm 120 may be configured: (1) to swivel/pivot along one, two, and/or three axes relative to mounting interface 130; and/or (2) to permit lighting device 110 to swivel/pivot along one, two, and/or three axes relative to mounting arm 120.

Also, as can be seen with particular reference to FIG. 8, mounting arm 120 may be configured, in some cases, to house or otherwise enclose wiring 1006 related to lighting device 110. In some such instances, mounting arm 120 may be configured to direct/guide wiring 1006 of lighting device 110, for example, to junction box 1004 (or other power supply). To that end, in some embodiments, mounting arm 120 may be configured as a substantially hollow structure (e.g., a tube) having any desired cross-sectional geometry (e.g., circular, elliptical, square, rectangular, polygonal, etc.). Other suitable configurations for mounting arm 120 will depend on a given application and will be apparent in light of this disclosure.

As previously noted, in some cases, light fixture 100 may include a mounting interface 130. In some embodiments, mounting interface 130 may be included at an end of supporting arm 120 (e.g., at the end that is opposite lighting device 110). Mounting interface 130 may be a canopy or other fixture/interface configured to physically couple lighting device 110 with mounting surface 1002 (e.g., by way of mounting arm 120) and/or electrically couple lighting device 110 with junction box 1004 (or other power supply). Other suitable configurations for mounting interface 130 will depend on a given application and will be apparent in light of this disclosure.

As will be appreciated in light of this disclosure, and in accordance with an embodiment, mounting arm 120 and/or mounting interface 130 may be constructed from any of the various materials discussed above, for example, in the context of housing 112. Other suitable materials for mounting arm 120 and/or mounting interface 130 will depend on a given application and will be apparent in light of this disclosure.

In accordance with an embodiment, lighting device 110 may be configured to be electrically coupled with driver circuitry (e.g., by wiring 1006). In some cases, the driver circuitry may be external to lighting device 110 (e.g., in an electrical junction box 1004 in a mounting surface 1002). As will be appreciated in light of this disclosure, by virtue of such a configuration, the driver circuitry may be, in some cases, substantially thermally isolated from lighting device 110; that is, the driver circuitry may be isolated/protected, at least in part, from experiencing substantial increases/decreases in temperature, even if lighting device 110 experiences such fluctuations. In some instances, this may help to increase the efficiency and/or lifetime of a given lighting device 110. In some cases, lighting device 110 optionally may include or otherwise be capable of being electrically coupled with ballast circuitry, for example, to convert an AC signal (e.g., supplied by electrical wiring in mounting surface 1002, such as at junction box 1004) into a DC signal at a desired current and voltage to power lighting device 110.

Figure 9:
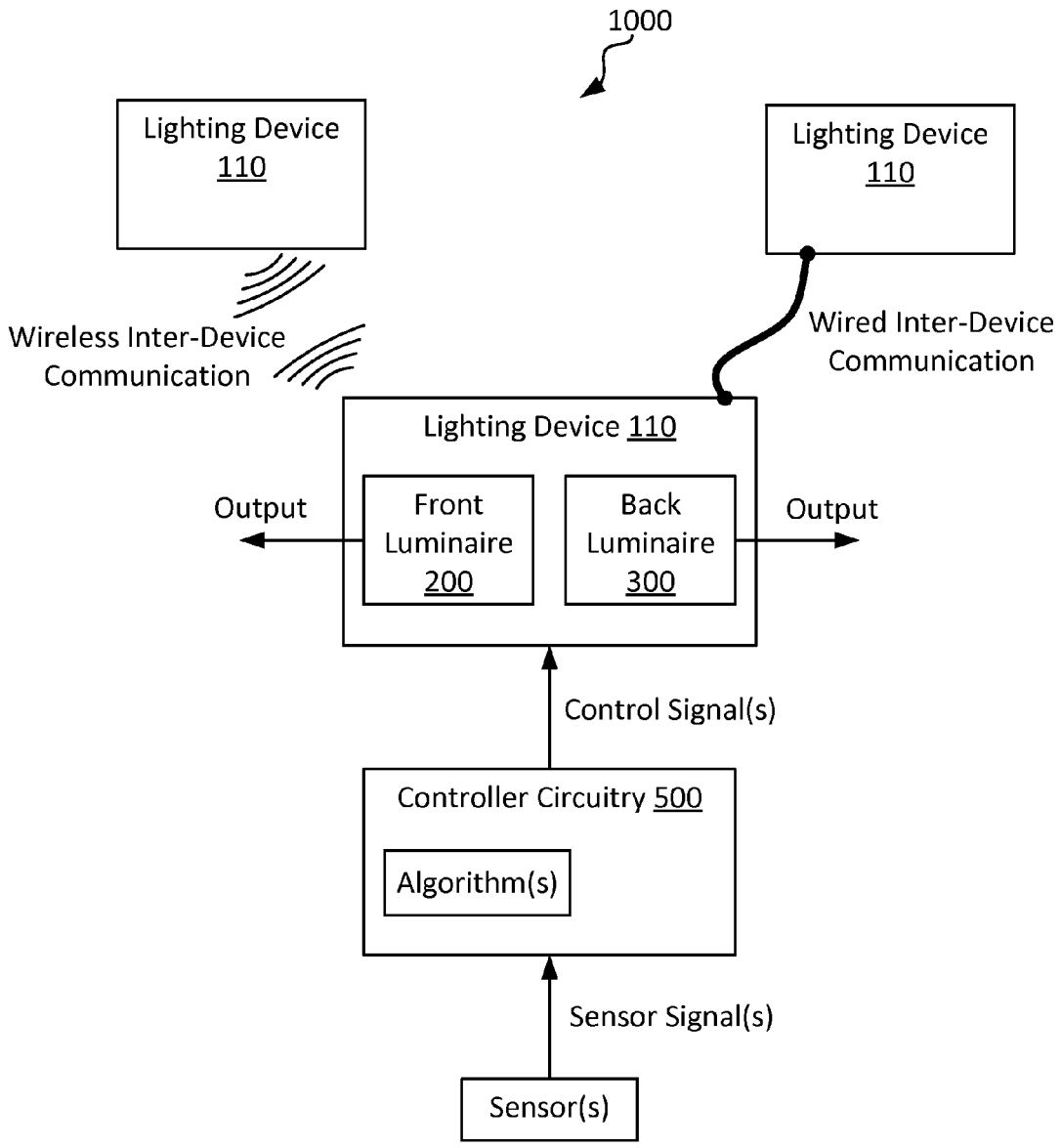
FIG. 9 is a block diagram of a lighting system configured in accordance with an embodiment of the present invention.

FIG. 9 is a block diagram of a lighting system 1000 configured in accordance with an embodiment of the present invention. As can be seen, system 1000 may include a plurality of lighting devices 110, at least one of which may be operatively coupled with controller circuitry 500 (discussed below) and/or one or more sensors. In some cases, and in accordance with an embodiment, the one or more lighting devices 110 of system 1000 may be configured for wired and/or wireless: (1) inter-device communication; and/or (2) communication with other devices, sensors, etc., as desired for a target application or end-use. In some instances, inter-device communication may be performed, for example, using infrared (IR) light modulation. However, the claimed invention is not so limited, as other wireless transmission technologies (e.g., RF transmission, Bluetooth®, etc.) may be used as desired, in some embodiments. In some cases, inter-device communication may be desirable, for example, for purposes of reprogramming controller circuitry 500, setting/updating color profiles, obtaining geographical location data, inputting user preferences, etc. Numerous configurations will be apparent in light of this disclosure.

Light Tuning/Mixing Considerations

As noted above in the context of FIG. 9, controller circuitry 500 may be operatively coupled with a lighting device 110 and configured, for example, to control the light output of a given luminaire 200/300 thereof. In accordance with an embodiment, controller circuitry 500 can be configured to generate one or more control signals, for example, to adjust the operation of: (1) the one or more light engines 242*a*/242*b* of front luminaire 200; and/or (2) the one or more light engines 342*a*/342*b* of back luminaire 300. For instance, in some example cases, controller circuitry 500 may provide light engines 242*a*/242*b* with dual-white (e.g., cool white and warm white) tuning/mixing capabilities within lightguide 210 of front luminaire 200. Furthermore, in some example cases, controller circuitry 500 may provide light engines 342*a*/342*b* with color (e.g., R-G-B, etc.) tuning/mixing capabilities within lightguide 310 of back luminaire 300.

As will be appreciated in light of this disclosure, any of a wide range of controller functions/devices may be included as part of controller circuitry 500. For instance, in some embodiments, controller circuitry 500 may include, for example, dimmer circuitry to control the brightness of the light engines 242*a*/242*b* and/or 342*a*/342*b*. In some embodiments, controller circuitry 500 may include circuitry to control the color of the light emitted by the light engines 242*a*/242*b* and/or 342*a*/342*b* (e.g., one or more of the light engines 242*a*/242*b* and/or 342*a*/342*b* may include two or more LEDs configured to emit light having different wavelengths, wherein the controller circuitry may adjust the relative brightness of the different LEDs in order to change the mixed color from the light engines 242*a*/242*b* and/or 342*a*/342*b*). In some cases, controller circuitry 500 may include, for instance, an ambient light sensor to adjust for changes in ambient lighting conditions. In some embodiments, controller circuitry 500 may include a temperature sensor to adjust for temperature changes. In some still other embodiments, controller circuitry 500 may include a sensor to adjust for changes in output due to lifespan changes. In some cases, lighting device 110 may include, for example, a touch-sensitive surface (e.g., as part of housing 112, front faceplate 114, back faceplate 116, etc.), which may be associated with any desired function/capability, such as powering on/off front luminaire 200 and/or back luminaire 300, switching between a daylight simulation mode and a fixed CCT mode, etc. Other suitable configurations and/or capabilities for controller circuitry 500 will depend on a given application and will be apparent in light of this disclosure.

In some embodiments, the controller circuitry 500 for lighting device 110 may be embedded (e.g., included locally on a given circuit board 240*a*/240*b* and/or 340*a*/340*b*). However, the claimed invention is not so limited, as in some other embodiments, controller circuitry 500 may be external to lighting device 110 (e.g., in an electrical junction box 1004, in/behind/on a mounting surface 1002, etc.). As will be appreciated in light of this disclosure, by virtue of such a configuration, controller circuitry 500 may be, in some cases, substantially thermally isolated from lighting device 110; that is, the controller circuitry 500 may be isolated/protected, at least in part, from experiencing substantial increases/decreases in temperature, even if lighting device 110 experiences such fluctuations. In some instances, this may help to increase the efficiency and/or lifetime of a given lighting device 110. Furthermore, in some cases, the controller circuitry 500 of a given lighting device 110 may be included as part of or otherwise operatively coupled with (e.g., hardwired, wirelessly, etc.) a building management system (BMS) (or other energy management system). Numerous configurations will be apparent in light of this disclosure.

As previously noted, and in accordance with an embodiment, controller circuitry 500 can be programmed or otherwise configured with one or more algorithms, for example, for mixing/tuning or otherwise controlling the color and/or intensity of the light output by a given luminaire 200/300. As will be appreciated in light of this disclosure, and in accordance with an embodiment, this may provide lighting device 110 with the ability to exhibit any of a wide variety of lighting profiles. The algorithms can be implemented, for example, in any suitable programming language (e.g., C, objective C, C++, proprietary instruction sets, etc.), and encoded on a machine-readable medium that, when executed by one or more processors, carries out the lighting control as variously described herein. Other embodiments can be implemented, for instance, with gate-level logic or an application-specific integrated circuit (ASIC) or chip set or other such purpose-built logic, or a microcontroller having input/output capability (e.g., inputs for receiving sensor signals and outputs for providing lighting control signals) and a number of embedded routines for carrying out the device functionality. In short, the lighting control algorithms for front luminaire 200 and/or back luminaire 300 can be implemented in hardware, software, firmware, or a combination thereof.

For example, in some embodiments, the controller circuitry 500 may include one or more algorithms which provide lighting device 110 with a daylighting profile which replicates daylight color and/or intensity changes. To that end, the controller circuitry 500 may be programmed with one or more algorithms, for example, which: (1) mix the ratio of warm and cool white light (e.g., dual-white emissions having a color temperature in the range of about 2700-6500 K) emitted by light engine(s) 242*a*/242*b* to cause front luminaire 200 to simulate the intensity, color, and/or color temperature of sunlight at any given time of day at a given geographical location; and/or (2) mix the colored (e.g., R-G-B, etc.) light emitted by light engine(s) 342*a*/342*b* to cause back luminaire 300 to show the colors of sunrise, sunset, and/or transitions there between, in some cases while accounting for the effect of weather patterns/environmental conditions (e.g., clear sky, overcast, clouds, fog, etc.). In some embodiments, controller circuitry 500 may be programmed with one or more daylighting algorithms, for example, such as those described in U.S. patent application Ser. No. 13/536,147, titled "MULTI-MODE COLOR TUNABLE LIGHT SOURCE AND DAYLIGHTING SYSTEM", which is herein incorporated by reference in its entirety.

However, the claimed invention is not so limited. For example, in some embodiments, lighting device 110 may be provided with a nighttime profile (e.g., a night sky, moonlight, starlight, etc.) by virtue of one or more algorithms implemented with the controller circuitry 500. In some cases, the controller circuitry 500 may be programmed with one or more algorithms, for example, which provide lighting device 110 with a real-time clock (RTC) profile, which may aid in providing a real sense/feeling of time regardless of inability to access/observe the outdoors. Furthermore, and in accordance with an embodiment, a given timing/daylighting/nighttime lighting profile can be freely adjusted/synchronized, as desired (e.g., astronomical time, according to the work day, opening times of stores, etc.). In some cases, profiles may be developed, for example, to replicate daylighting conditions perceived on Earth's surface for use in settings which otherwise would experience significantly different daylighting conditions (e.g., deep sea, space, other planets/celestial bodies, etc.). In some such cases, this may aid in keeping a human, animal, etc., in sync with daytime/nighttime light patterns which typically would be experienced on Earth's surface. Numerous configurations will be apparent in light of this disclosure.

In some embodiments, controller circuitry 500 may include one or more algorithms which cause lighting device 110 to produce specific lighting conditions, for instance, based on physiological considerations. For example, as previously discussed, lighting device 110 may be provided, in some cases, with a nighttime lighting profile which shows colors which are conducive to sleep processes or otherwise supportive of circadian rhythm responses (e.g., blue light may aid in suppressing melatonin production). Conversely, in some cases, lighting device 110 may be caused to emit light, for example, which aids in awakening processes.

In some cases, lighting device 110 may be provided with lighting profiles which provide a desired ambient mood lighting (e.g., fosters a calm environment, for example, for a yoga studio; fosters an excited environment, for example, for a sports center; etc.). In some cases, lighting profiles which alter, support, or otherwise modify physiological processes/conditions (e.g., moods, behaviors, etc.) of humans, animals, etc., may be provided. For example, lighting device 110 may be caused to emit light which is conducive to human health/well-being, improves worker productivity in a given workplace, etc. As a further example, lighting device 110 may be caused to emit light which is conducive to establishing a sense of time (e.g., in a hotel hallway/room, lighting device 110 may be used to aid in acclimating travelers arriving from different time zones). In some instances, end-user personal preference options may be offered (e.g., user-customized lighting profiles tailored to the user's preferences). Numerous variations and configurations will be apparent in light of this disclosure.

Form Factor Considerations

As will be appreciated in light of this disclosure, it may be desirable, in some instances, to provide a light fixture 100 that is aesthetically pleasing or otherwise complementary to the environment/setting in which it is to be utilized. To that end, and in accordance with an embodiment, any of mounting interface 130, mounting arm 120, and/or housing 112 (e.g., with faceplate 114 and/or 116) may be provided with any given aesthetic/ornamental feature(s), as desired for a given target application or end use. For instance, the size, geometry, color, lines/curves, profile, footprint, etc., of any of the aforementioned may be customized, in accordance with one or more embodiments, as desired for a given target application or end-use. Numerous configurations will be apparent in light of this disclosure.

Also, it should be noted that while some embodiments of the present invention are discussed in the example context of being physically coupled/mounted with a mounting surface, the claimed invention is not so limited. For instance, in some other embodiments, lighting device 110 (or more generally, light fixture 100) may be portable or otherwise mobile. As previously noted, in some cases, lighting device 110 may be configured to be battery-operated. Furthermore, in some cases, lighting device 110 may include one or more ports, for example, capable of being electrically connected with a power source for charging, use, etc. Numerous configurations and variations will be apparent in light of this disclosure.

In some cases, lighting device 110 (and/or controller circuitry 500) optionally may be configured for updating (e.g., of algorithms, location data, user preferences, etc.). In some cases, updating may be achieved through a hardwired interface (e.g., USB, Ethernet, FireWire, disc drive, etc.). However, the claimed invention is not so limited, as updating also may be achieved wirelessly, in some instances. Other suitable techniques/structure for updating will depend on a given application and will be apparent in light of this disclosure.

Given that daylight parameters (e.g., sunrise, sunset, etc.) generally vary depending on geographical location, it may be desirable, in some instances, to enable lighting device 110 to determine its location on Earth. To that end, and in accordance with an embodiment, lighting device 110 (and/or controller circuitry 500) may be configured to derive its location, for example, from a global positioning system (GPS) sensor, a smartphone or other device, an internet connection (wired and/or wireless), software, user input, and/or any other suitable source of such information, as will be apparent in light of this disclosure. In some cases, and in accordance with an embodiment, this may aid a given lighting device 110 in achieving a desired daylighting profile that is accurate to a given geographical location on Earth.

Numerous embodiments will be apparent in light of this disclosure. One example embodiment of the present invention provides a lighting system including a first luminaire including a first light source configured to emit white light, a second luminaire including a second light source configured to emit colored light, and lighting controller circuitry operatively coupled with the second light source and configured to mix the colored light emitted by the second light source. In some such cases, the first light source includes a plurality of dual-white light emitting diodes (LEDs), and the lighting controller circuitry is further configured to mix the white light emitted by the first light source. In some such instances, the resultant mixed white light has a color temperature in the range of about 2700-6500 K. In some other such instances, the resultant mixed white light simulates at least one of an intensity, color, and/or color temperature of sunlight. In some cases, the second light source comprises a plurality of red-green-blue (R-G-B) light emitting diodes (LEDs). In some instances, the resultant mixed colored light simulates at least one of an intensity, color, and/or a color temperature of the sky. In some cases, the lighting controller circuitry is embedded with at least one of the first luminaire and/or the second luminaire. In some example cases, the lighting system is configured as a wall sconce. In some instances, the lighting system further includes a diffuser optically coupled with the first luminaire, wherein light emitted by the first luminaire passes through the diffuser. In some such instances, the first luminaire includes a mask, the mask at least one of providing the first luminaire with a non-emitting region, providing a reduction in intensity of light emitted by the first luminaire, reducing glare from the first luminaire, and/or redirecting light emitted from the first luminaire. In some cases, the lighting system is configured to be electrically coupled with an electrical junction box. In some cases, the lighting system is configured to be electrically coupled with a battery. In some cases, the lighting system is configured to be portable/mobile.

Another example embodiment of the present invention provides a lighting system including a lighting device including a first luminaire including a first plurality of light emitting diodes (LEDs) and a second luminaire including a second plurality of LEDs, and controller circuitry operatively coupled with the lighting device, wherein the controller circuitry is configured to alter a characteristic of light emitted by at least one of the first plurality of LEDs and/or the second plurality of LEDs. In some cases, the characteristic of light comprises at least one of intensity, color, and/or color temperature. In some instances, the controller circuitry is at least one of embedded with the lighting device and/or included in an electrical junction box with which the lighting device is electrically coupled. In some cases, the controller circuitry causes the lighting device to emit light which simulates lighting conditions/patterns corresponding to at least one of daytime and/or nighttime on Earth. In some example instances, the controller circuitry causes the lighting device to emit light which is intended to at least one of support and/or alter a physiological process in a living being. In example instances, the controller circuitry causes the lighting device to emit light which is intended to at least one of foster and/or alter a mood of a living being. In some cases, the lighting system further includes a sensor operatively coupled with the controller circuitry, the sensor for sensing at least one of latitude and longitude of current location, changes in natural ambient lighting conditions, changes in temperature, and/or changes in LED lifespan, wherein the controller circuitry is configured to alter the characteristic of light emitted by at least one of the first plurality of LEDs and/or the second plurality of LEDs based on signals from the sensor.

Another example embodiment of the present invention provides a lighting device including a first luminaire configured to emit white light having a color temperature in the range of about 2700-6500 K and a second luminaire configured to emit colored light, wherein the light emitted by the first luminaire and by the second luminaire is tuned by controller circuitry operatively coupled with the lighting device. In some cases, a light fixture including the lighting device is provided, the light fixture further including a mounting arm coupled with the lighting device, the mounting arm configured to be mounted to a surface. In some instances, a lighting system including a plurality of the lighting device is provided. In some such instances, at least two lighting devices of the plurality of lighting devices are configured to communicate with one another.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A lighting system comprising:

a first luminaire including a first light source configured to emit white light from a front facing surface of the lighting system wherein the resultant white light simulates at least one of an intensity, color and/or color temperature of sunlight;

a second luminaire including a second light source configured to emit colored light from a rear facing surface of the lighting system and producing a wash of emitted colored light on a surface to which the lighting system is mounted and wherein the resultant mixed colored light simulates at least one of an intensity, color, and/or temperature of the sky; and lighting controller circuitry operatively coupled with the first light source and the second light source wherein the light emitted by the first luminaire and by the second luminaire is tuned to adjust at least one of an intensity, color and/or color temperature to simulate changes in the sunlight and the sky over a period of daytime.

2. The lighting system of claim 1, wherein the first light source comprises a plurality of dual-white light emitting diodes (LEDs), and wherein the lighting controller circuitry is further configured to mix the white light emitted by the first light source.

3. The lighting system of claim 2, wherein the resultant mixed white light has a color temperature in the range of about 2700-6500 K.

4. The lighting system of claim 2, wherein the resultant mixed white light simulates a color temperature of sunlight.

5. The lighting system of claim 1, wherein the second light source comprises a plurality of red-green-blue (R-G-B) light emitting diodes (LEDs).

6. The lighting system of claim 1, wherein the resultant mixed colored light simulates a color temperature of the sky.

7. The lighting system of claim 1, wherein the lighting controller circuitry is embedded with at least one of the first luminaire and/or the second luminaire.

8. The lighting system of claim 1, wherein the lighting system is configured as a wall sconce.

9. The lighting system of claim 1 further comprising a diffuser optically coupled with the first luminaire, wherein light emitted by the first luminaire passes through the diffuser.

10. The lighting system of claim 1, wherein the first luminaire includes a mask, the mask at least one of providing the first luminaire with a non-emitting region, providing a reduction in intensity of light emitted by the first luminaire, reducing glare from the first luminaire, and/or redirecting light emitted from the first luminaire.

11. The lighting system of claim 1, wherein the lighting system is configured to be electrically coupled with an electrical junction box.

12. The lighting system of claim 1, wherein the lighting system is configured to be electrically coupled with a battery.

13. The lighting system of claim 1, wherein the lighting system is configured to be portable/mobile.

14. A lighting system comprising:

a lighting device comprising:

a first luminaire including a first plurality of light emitting diodes (LEDs); and a second luminaire including a second plurality of LEDs; and controller circuitry operatively coupled with the lighting device, wherein the controller circuitry is configured to alter a characteristic of light emitted by at least one of the first plurality of LEDs and/or the second plurality of LEDs; and a sensor operatively coupled with the controller circuitry, the sensor for sensing at least one of latitude and longitude of current location, changes in natural ambient lighting conditions, changes in temperature, and/or changes in LED lifespan, wherein the controller circuitry is configured to alter the characteristic of light emitted by at least one of the first plurality of LEDs and/or the second plurality of LEDs based on signals from the sensor.

15. The lighting system of claim 14, wherein the characteristic of light comprises at least one of intensity, color, and/or color temperature.

16. The lighting system of claim 14, wherein the controller circuitry is at least one of embedded with the lighting device and/or included in an electrical junction box with which the lighting device is electrically coupled.

17. The lighting system of claim 14, wherein the controller circuitry causes the lighting device to emit light which simulates lighting conditions/patterns corresponding to at least one of daytime and/or nighttime on Earth.

18. The lighting system of claim 14, wherein the controller circuitry causes the lighting device to emit light which is intended to at least one of support and/or alter a physiological process in a living being.

19. The lighting system of claim 14, wherein the controller circuitry causes the lighting device to emit light which is intended to at least one of foster and/or alter a mood of a living being.

20. A wall sconce comprising:

a first luminaire configured to emit white light from a front facing surface of the wall sconce and the emitted light having a color temperature in the range of about 2700-6500 K wherein the resultant mixed white light simulates at least one of an intensity, color and/or color temperature of sunlight; and a second luminaire configured to emit colored light from a rear facing surface of the wall sconce and producing a wall wash of emitted colored light on a wall surface to which the wall sconce is mounted and wherein the resultant mixed colored light simulates at least one of an intensity, color, and/or temperature of the sky;

wherein the light emitted by the first luminaire and by the second luminaire is tuned to adjust at least one of an intensity, color and/or color temperature to simulate changes in the sunlight or the sky over a period of daytime as seen from earth by controller circuitry operatively coupled with the wall sconce.

21. A light fixture comprising the wall sconce of claim 20 and further comprising:

a mounting arm coupled with the wall sconce, the mounting arm configured to be mounted to the wall surface.

22. A lighting system comprising a plurality of the wall sconce of claim 20.

23. The lighting system of claim 22, wherein at least two wall sconces of the plurality of wall sconces are configured to communicate with one another.

* * * * *